US012781616B2

(12) United States Patent
Qi et al.

(10) Patent No.: US 12,781,616 B2
(45) Date of Patent: Nov. 3, 2026

(54) DOWNHOLE MEASUREMENTS OF BOREHOLE MUD AND CEMENTING PROPERTIES

(71) Applicant: Halliburton Energy Services, Inc., Houston, TX (US)

(72) Inventors: Yingyu Qi, Singapore (SG); Ruijia Wang, Singapore (SG); Yadong Wang, Singapore (SG); Xiang Wu, Houston, TX (US); Ramiro Andres Gonzalez Carrillo, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 173 days.

(21) Appl. No.: 18/771,912

(22) Filed: Jul. 12, 2024

(65) Prior Publication Data

US 2026/0015935 A1 Jan. 15, 2026

(51) Int. Cl.
*E21B 47/20* (2012.01)
*E21B 47/005* (2012.01)

(52) U.S. Cl.
CPC ..... *E21B 47/005* (2020.05); *E21B 47/20* (2020.05)

(58) Field of Classification Search
CPC ..... E21B 47/005; E21B 47/20
See application file for complete search history.

(56) References Cited

U.S. PATENT DOCUMENTS 7,650,241 B2 1/2010 Jogi et al.
2009/0105957 A1 4/2009 Hsu et al.
2011/0138903 A1* 6/2011 Large ..... E21B 17/1021 73/152.17
2016/0202387 A1 7/2016 Fox et al.
2018/0003843 A1 1/2018 Hori et al.
2022/0049600 A1* 2/2022 Li ..... E21B 47/005
2023/0243220 A1* 8/2023 Fanini ..... E21B 47/09 166/241.5

FOREIGN PATENT DOCUMENTS

EP 2662605 B1 7/2019

OTHER PUBLICATIONS

International Search Report and Written Opinion for International Patent Application No. PCT/US2024/039721 dated Mar. 20, 2025. PDF file. 8 pages.

(Continued)

*Primary Examiner* — Krystine E Breier
(74) *Attorney, Agent, or Firm* — Michael Jenney; C. Tumey Law Group PLLC

(57) ABSTRACT

A method or system comprising: disposing an acoustic logging tool into a borehole, wherein the acoustic logging tool is configured to: transmit one or more acoustic waves into the borehole with one or more transmitters; and receive one or more waveforms from the borehole or surrounding casing with an array of receivers. In addition, the method ay also comprise an information handling system configured to predict one or more waveforms at a shifted position with two waveforms recorded at an in-line position to form one or more predicted waveforms at a shifted position; and compare the one or more predicted waveforms at a shifted position with at least one or more waveforms recorded at a shifted position to yield a borehole mud attenuation and/or velocity.

20 Claims, 4 Drawing Sheets

(56) References Cited

OTHER PUBLICATIONS

He, X., Chen, H., and Wang, X. (2014). Ultrasonic leaky flexural waves in multilayered media: Cement bond detection for cased wellbores. Geophysics, 79(2), A7-A11.

Klieber, C., and Brill, T.M. (2017, June). Mapping of ultrasonic Lamb-wave field in elastic layered structures using laser probes in Proceedings of meetings on Acoustics (vol. 30, No. 1). AIP Publishing.

* cited by examiner

DOWNHOLE MEASUREMENTS OF BOREHOLE MUD AND CEMENTING PROPERTIES

BACKGROUND

For oil and gas exploration and production, a network of wells, installations and other conduits may be established by connecting sections of metal pipe together. For example, a well installation may be completed, in part, by lowering multiple sections of metal pipe (i.e., a casing string) into a wellbore, and cementing the casing string in place. In some well installations, multiple casing strings are employed (e.g., a concentric multi-string arrangement) to allow for different operations related to well completion, production, or enhanced oil recovery (EOR) options.

During a well installation's life, logging operations may be performed to determine material behind a pipe string. Specifically, acquiring a cement bond between formation and steel casing to reinforce the downhole wellbore. The cement bond may also show the cementing layer which may restrict flows from formations and isolate fluids. However the quality of cementation might reduce overtime, so there is a need perform cement evaluation by acquiring a cement bond as part of surveillance schemes to guarantee that the downhole wellbore is in good condition.

For cement evaluation, one common way is to use Cement Bond Log (CBL). The CBL is a sonic tool that operates at an operating frequency. In examples, the operating frequency may be 20 KHz. Thus, it loses azimuthal resolution and is hard to detect channeling in poor condition cement. Another way is to apply ultra sonic tools which use methods such as Pulse Echo. Pulse Echo is sensitive to debonding cement layer, but it only provides apparent annulus impedance. The annulus impedance overlaps for light cement and mud overlaps, so Pulse Echo loses some resolution in light cement situation.

Pitch Catch gives a more reliable solution in such conditions. But to measure flexural mode attenuation, Pitch Catch utilizes an aligned array of receivers for reducing the influence from borehole mud. But if the borehole mud is attenuative, an aligned array of receivers is still affected and becomes less accurate. As such, to measure the borehole mud properties, it requires the implementation of additional tools such as mud cell. Implementing a mud cell requires logging mud. Since the logging mud is not homogeneous due to large pressure and temperature change, mud cell may measure and perform full logging runs multiple times at different depth. For deep downhole mud measurement, using mud cell to measure mud at different depth will give additional cost and be less time efficiency.

Moreover, after the tool collecting downhole mud, the sample may dehydrate when pulling to surface and becomes mud cake. This will introduce bias in final measurement. Additionally, the accuracy with predicting the material behind casing is often low as human determination of recorded data may be faulty.

BRIEF DESCRIPTION OF THE DRAWINGS

These drawings illustrate certain aspects of some examples of the present disclosure and should not be used to limit or define the disclosure.

DETAILED DESCRIPTION

This disclosure may generally relate to methods and systems for using a receiver array with different radial depth for the Pitch Catch method for cement and borehole measurements. This method can give both annulus and borehole mud information with the same equipment. Joint interpretation using both Pulse Echo and Pitch Catch may be applied. Joint implementation of the measurement of borehole mud will be more accurate and, in this way, it can lower costs in hardware development because it doesn't require additional parts and save time logging with multiple tools.

Figure 1:
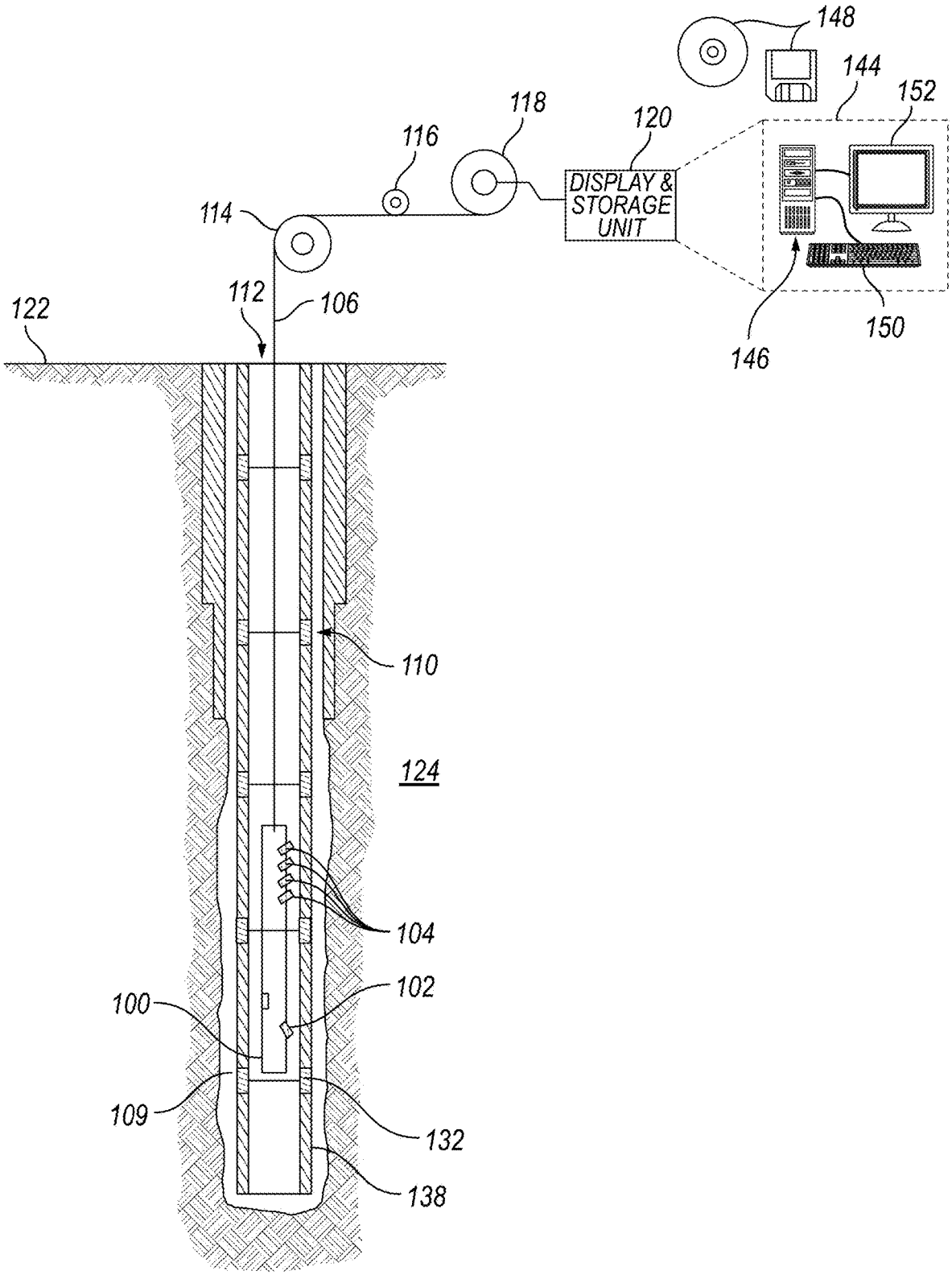
FIG. 1 illustrates a system including an acoustic logging tool.

FIG. 1 illustrates an operating environment for an acoustic logging tool 100 as disclosed herein. Acoustic logging tool 100 may comprise a transmitter 102 and/or an array of receivers 104. In examples, there may be any number of transmitters 102 and/or any number of receivers in array of receivers 104, which may be disponed on acoustic logging tool 100. Acoustic logging tool 100 may be operatively coupled to a conveyance 106 (e.g., wireline, slickline, coiled tubing, pipe, downhole tractor, and/or the like) which may provide mechanical suspension, as well as electrical connectivity, for acoustic logging tool 100. Conveyance 106 and acoustic logging tool 100 may extend within casing string 138 to a desired depth within the wellbore 110. Wellbore 110 may extend vertically or horizontally into formation 124. Conveyance 106, which may include one or more electrical conductors, may exit wellhead 112, may pass around pulley 114, may engage odometer 116, and may be reeled onto winch 118, which may be employed to raise and lower the tool assembly in the wellbore 110.

Signals recorded by acoustic logging tool 100 may be stored on memory and then processed by display and storage unit 120 after recovery of acoustic logging tool 100 from wellbore 110. Alternatively, signals recorded by acoustic logging tool 100 may be conducted to display and storage unit 120 by way of conveyance 106. Display and storage unit 120 may process the signals, and the information contained therein may be displayed for an operator to observe and stored for future processing and reference. Alternatively, signals may be processed downhole prior to receipt by display and storage unit 120 or both downhole and at surface 122, for example, by display and storage unit 120. Display and storage unit 120 may also contain an apparatus for supplying control signals and power to acoustic logging tool 100. Typical casing string 138 may extend from wellhead 112 at or above ground level to a selected depth within a wellbore 110. Casing string 138 may comprise a plurality of joints 130 or segments of casing string 138, each joint 130 being connected to the adjacent segments by a collar 132. There may be any number of layers in casing string 138. For example, a first casing 134 and a second casing 136. It should be noted that there may be any number of casing layers.

FIG. 1 also illustrates a typical casing 138, which may be positioned inside annulus 109 of wellbore 110. Casing 138 may be production tubing, tubing string, casing string, or another pipe disposed within wellbore 110. Casing 138 may comprise concentric pipes. It should be noted that concentric pipes may be connected by collars 132. Acoustic logging tool 100 may be dimensioned so that it may be lowered into the wellbore 110 through casing 138.

In logging systems, such as, for example, logging systems utilizing the acoustic logging tool 100, a digital telemetry system may be employed, wherein an electrical circuit may be used to both supply power to acoustic logging tool 100 and to transfer data between display and storage unit 120 and acoustic logging tool 100. A DC voltage may be provided to acoustic logging tool 100 by a power supply located above ground level, and data may be coupled to the DC power conductor by a baseband current pulse system. Alternatively, acoustic logging tool 100 may be powered by batteries located within the downhole tool assembly, and/or the data provided by acoustic logging tool 100 may be stored within the downhole tool assembly, rather than transmitted to the surface during logging (corrosion detection).

Acoustic logging tool 100 may be used for excitation of transmitter 102. As illustrated, array of receivers 104 may be positioned on the acoustic logging tool 100 at selected distances (e.g., axial spacing) away from transmitter 102. The axial spacing of array of receivers 104 from transmitter 102 may vary, for example, from about 0 inches (0 cm) to about 40 inches (101.6 cm) or more. In some embodiments, at least one receiver from array of receivers 104 may be placed near the transmitter 102 (e.g., within at least 1 inch (2.5 cm)) while one or more additional receivers may be spaced from 1 foot (30.5 cm) to about 5 feet (152 cm) or more from the transmitter 102. It should be understood that the configuration of acoustic logging tool 100 shown on FIG. 1 is merely illustrative and other configurations of acoustic logging tool 100 may be used with the present techniques. In addition, acoustic logging tool 100 may include more than one transmitter 102 and more than one receiver from array of receivers 104. For example, an array of receivers 104 may be used. Transmitters 102 may include any suitable acoustic source for generating acoustic waves downhole, including, but not limited to, monopole and multipole sources (e.g., dipole, cross-dipole, quadrupole, hexapole, or higher order multi-pole transmitters). Specific examples of suitable transmitters 102 may include, but are not limited to, piezoelectric elements, bender bars, transducers, or other transducers suitable for generating acoustic waves downhole. Array of receivers 104 may comprise any suitable acoustic receiver suitable for use downhole, including piezoelectric elements that may convert acoustic waves into an electric signal.

Figure 2:
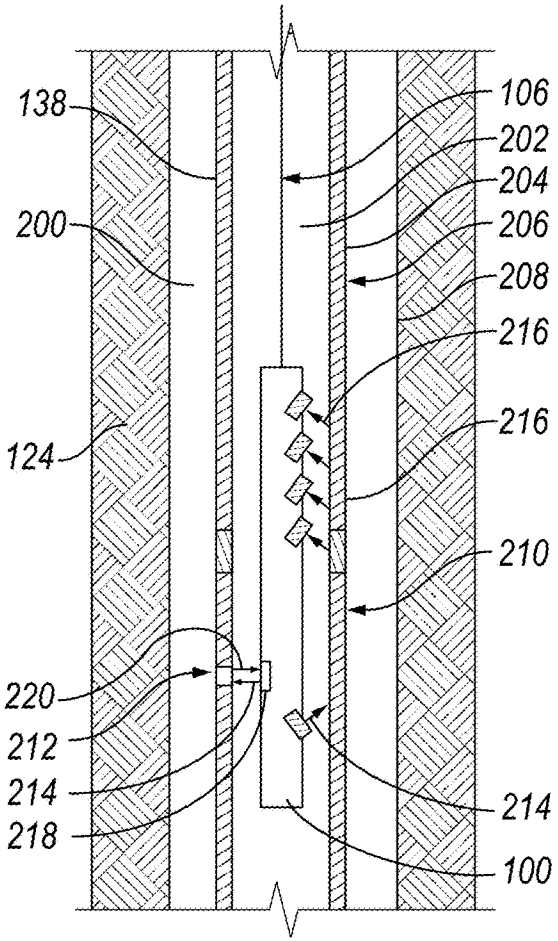
FIG. 2 illustrates a traditional acoustic logging operations.

FIG. 2 illustrates a traditional acoustic logging tool 100 during logging operations. As illustrated, logging operations (for the methods and systems discussed below) may utilize ultrasonic pulse-echo and pitch catch flexural waves generated from one or more transmitters 102 and recorded by array of receivers 104 to evaluate a condition of a material 200 behind casing 138. During operations, acoustic logging tool 100 is suspended within mud of borehole 202 by conveyance 106. As noted above, to form an acoustic log, ultrasonic pulse-echo and pitch catch flexural waves are generated and recorded. Both waves, which are produced by different systems and methods on acoustic logging tool 100, may be used to analyze material 200 behind casing 138. As illustrated, there may be at least three interfaces in which acoustic waves may reflect and/or refract. Those interfaces are a first interface 204, a second interface 206, and third interface 208. First interface 204 is defined as a location in which mud of borehole 202 contacts the inner surface of casing 138. Second interface 206 is defined as a location in which the outer surface of casing 138 contacts with a material 200. Third interface 208 is defined as a location in which material 200 contacts formation 124. For pitch-catch methods 210, transmitters 102 and array of receivers 104 may be tilted at or about 35 degrees with respect to a longitudinal axis of acoustic tool 100. In examples, the angle may depend on the properties of casing 138, mud within borehole 202, and application of Snell's law. An angle may be found by applying Snell's law using a phase velocity of a flexural mode of casing 138 and a sound speed of mud within borehole 202 within casing 138. This may allow for generated acoustic wave 214 from transmitter 102 to travel along any of the above identified interfaces and be recorded by array of receivers 104 as one or more flexural waves 216. In examples, array of receivers 104 may record waveforms. In examples, waveforms may have been reflected waves transmitted from transmitter 102. Waveforms may have traveled through the borehole 202 and/or one or more layers through casing 138 and material 200. In examples, material 200 may comprise cement. Waveforms may further include noise or other static properties as well as information from borehole 202 or casing 138. In a pulse-echo method 212, acoustic wave 214 may be transmitted and received as a S1 mode wave 220 by transducer 218. In examples, acoustic wave 214 may be sonic or ultrasonic, or at any other frequency. In such method, sonic or acoustic wave 214 may be transmitted from transducer 218 about perpendicular to pipe casing 138. Acoustic wave 214 may reflect and/or refract off any of the above identified interfaces and is recorded as one or more S1 mode wave 220 by transducer 218. Recorded S1 mode wave 220 may be processed similarly to flexural waves 216. Processed S1 mode wave 220 and flexural waves 216 may be recorded as acoustic impedance in units of Rayls. The acoustic log may further be processed with machine learning models to process the recorded flexural waves 216 and S1 mode wave 220 to determine the material 200 behind casing 138. In examples, casing 138 may comprise a plurality of layers forming a concentric structure of casing 138.

Figure 3:
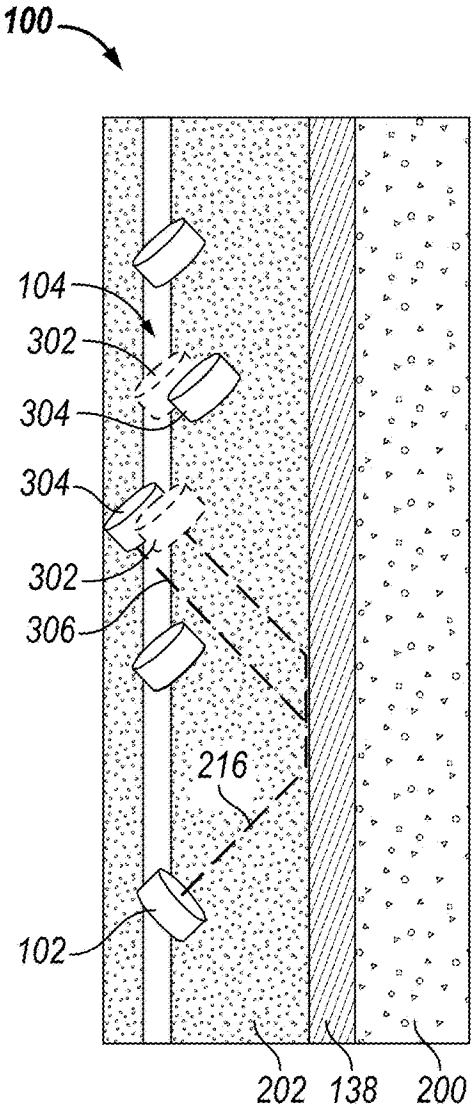
FIG. 3 illustrates a new acoustic logging tool during logging operations.

FIG. 3 illustrates a new acoustic logging tool 100 during logging operations. Acoustic logging tool 100 may comprise any number of transmitters 102 and/or any number of receivers in array of receivers 104. Array of receivers may be configured to record one or more flexural waves 216 or acoustic wave 214 from transmitter 102. As illustrated, the second and third receivers have been shifted from original in-line position 302 to shifted position 304. Herein, the shift may be about 0.25 inches along the radial direction. In examples the shift may be any possible radial length from 0.0001 inches to the full radial length of the tool. Further, FIG. 3 illustrates four receivers in array of receivers 104 with the second and third receivers shifted. However, there may be as few as three receivers in array of receivers 104 with only one of them shifted and there is no upper limit on the number of total receivers or the number of receivers which are shifted. In general, any of the three or more Shifted observation 306 may occur in the shifted receivers 104. Shifted observation 306 may convey borehole mud information, to be discussed further below.

Figure 4:
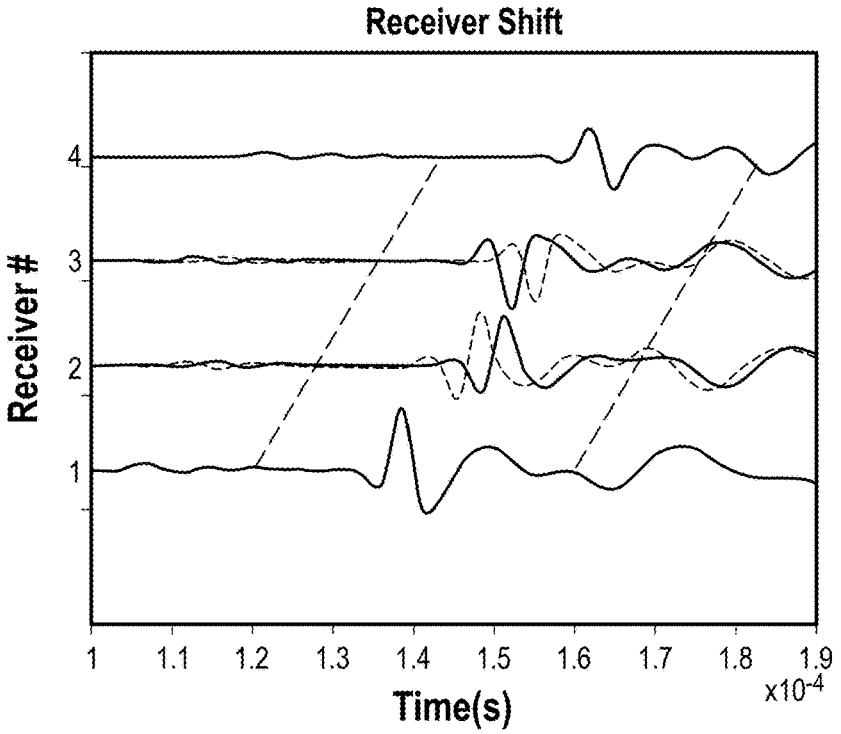
FIG. 4 illustrates amplitude observed by all four receivers.

FIG. 4 illustrates amplitude observed by all four receivers 104 from FIG. 3. For the second and third receivers 104 (e.g., referring to FIG. 3), the blue dashed line is the waveform at original in-line position 302 in FIG. 3. Processing techniques described herein may utilize four received signals to infer two set of waveforms and minimize the misfit to get borehole mud and lamb wave attenuations and velocities. In examples, the non-shifted receiver waveforms are utilized to predict the waveforms at the waveforms at original in-line position 302. This prediction yields only the attenuation and arrival time information of lamb waves in casing 138. Then the sifted receiver waveforms are utilized to predict the waveform at original in-line position 302 as well. This prediction yields the borehole mud attenuation and velocities. Finally, the misfit between the two sets of predicted waveforms may be performed, yielding final optimal borehole mud and lamb wave attenuation and velocity.

Figure 5:
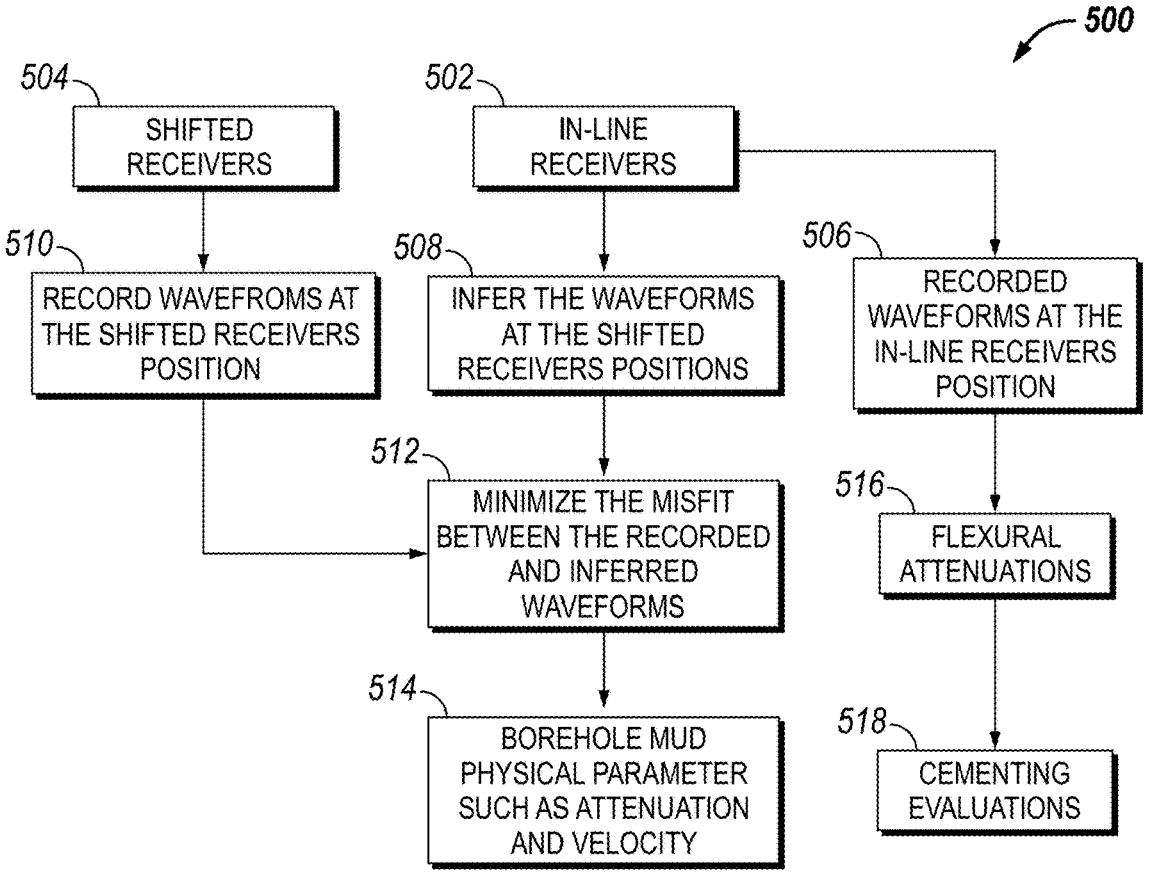
FIG. 5 illustrates a workflow.

FIG. 5 illustrates workflow 500. In examples, workflow 500 may be performed on information handling system 144. In blocks 502 and 504, measurements from array of receivers 104 (e.g., referring to FIG. 3) may be acquired. In examples, these measurements may be waveforms from original in-line position 302 and shifted position 304, respectfully. The recorded waveform may be in time domain and be in amplitude by time. In block 506, measurements from in-line receivers at original in-line position 302 may be used to calculate wave behavior in casing such as flexural attenuations. Based on wave behavior, cementing evaluation may be performed. In examples, the flexural attenuations for good bonded and bad bonded or debonding wellbore is different. For example, as the acoustic wave travels in a casing with good, bonded cement, it may have a higher attenuation than in casing with bad bonded or debonding cement. Receivers at in-line position 302 may be used to measure the flexural attenuations. As such, the strength of flexural attenuation may be used to evaluate if the cement is fully bonded or debonding. In block 508, measurements from receivers at original in-line position 302 and flexural attenuations determined in block 516 (to be discussed in detail below) may be used to predict the waveform for receivers located at shifted position 304. Predicting one or more waveforms at a shifted position based at least on the flexural attenuation in the casing, flexural velocity in the casing, and an initial guess of mud attenuation and velocity based on a prior knowledge in mud properties.

In examples, a fast fourier transform may be performed on the waveform recorded at In-line receivers in block 502 and to derive frequency domain signals. In block 508, a series of computations may be performed on a waveform from one or more sample frequencies identified by the fast fourier transform. In examples, a series of computations may be performed on multiple waveforms from multiple sample frequencies. For a series of computations, a sample frequency $f_0$ may be selected, then Equation (1) may be utilized to predict waveform propagation v for each frequency, where Equation (1) is:

$$v(t) = A * e^{-i(\omega t+\varphi)} \tag{1}$$

Where A is amplitude of the waveform, w is angular velocity, and φ is initial phase, and t is time. With wave propagation computed, attenuation now may computed with known amplitude. For example, the amplitude A is a function of attenuations a as in Equation (2):

$$A(x) = A_0 * e^{-(\alpha x)} \tag{2}$$

Where $A_0$ is the initial amplitude, x is the distance that the wave travels, and α is attenuation. Equation (2) may be re-written to solve for a is attenuation. For example, the attenuation α can be replaced by a quality factor Q as calculated in Equation (3):

$$\alpha = \frac{\pi * f_0}{Q} \tag{3}$$

Where $f_0$ is the selected sample frequency $$f_0 = \frac{\omega}{2\pi}$$

and Q is a measured quality factor. Just like attenuation of cement, quality factor Q may be dependent on cement bonding. As such, applying equation (1) and (2), measurements from receivers at original in-line position 302 (e.g., referring to FIG. 3) (i.e., block 502) may be utilized to predict waveforms at shifted position 304 in frequency domain. In examples, solving for mud velocity with α attenuation and waveform propagation v.

Then, an inverse fourier transform is performed on the predicted frequency domain signals to yield the corresponding waveforms in time domain. In block 510, measurements from shifted receivers at shifted position 302 may be used to calculate wave behavior in casing such as flexural attenuations.

In block 512 borehole mud attenuations and velocities may be determined from the predicted wave from block 508 and the measured wave from block 510. Mud attenuations a and wave travel time t in mud may be determined by minimizing the difference between the recorded waveform from the shifted receivers and the predicted waveform from the in-line receivers. Mud velocity $v_m$ is then given by $$v = \frac{s}{t},$$

where s is the shift distance in meters and t is time. In block 514, borehole mud attenuations and velocities may be recorded at various operating frequencies $f_0$.

In block 516, flexural attenuations or lamb wave (including antisymmetric or symmetric modes A0, S0, A1, S1 . . . ) attenuations are measured using waveforms from block 506 recorded at block 502 in-line receivers. Such flexural attenuations may be used for cementing evaluations. For example, the measured flexural attenuation of a good bonded wellbore will be larger than the flexural attenuation of a bad bonded or debonding wellbore.

Communication between block 514 and 516 for determining a remediation plan using the borehole mud attenuations and velocities determined in block 512 and flexural attenuations determined in block 506 respectfully may be performed. For example, if the cement evaluation using flexural attenuations indicates damaged, eroded, or otherwise non-ideal cement a remediation plan may be required at the identified depth. To prepare the remediation plan, borehole mud attenuations and velocities may either enhance or alter the information from the cement evaluation or the remediation plan itself.

Table 1 provides theoretical mud attenuation in (db/in) and mud velocity in (m/s) for 0 db/in of every receiver. $V_p$ is mud velocity. Predicted values may be from receivers at original in-line position 302 (e.g., referring to FIG. 3). The Real Value may be from receivers at shifted position 304. Test 1 and Test 2 are two test cases.

| | | Test 1 | Test 2 |
|---|---|---|---|
| Predicted Value | Mud Attenuation (db/in) | 0.14 | 2.63 |
| | Mud Vp (m/s) | 1501 | 1490 |
| Real Value | Mud Attenuation (db/in) | 0 | 2.7 |
| | Mud Vp (m/s) | 1500 | 1500 |

Figure 6:
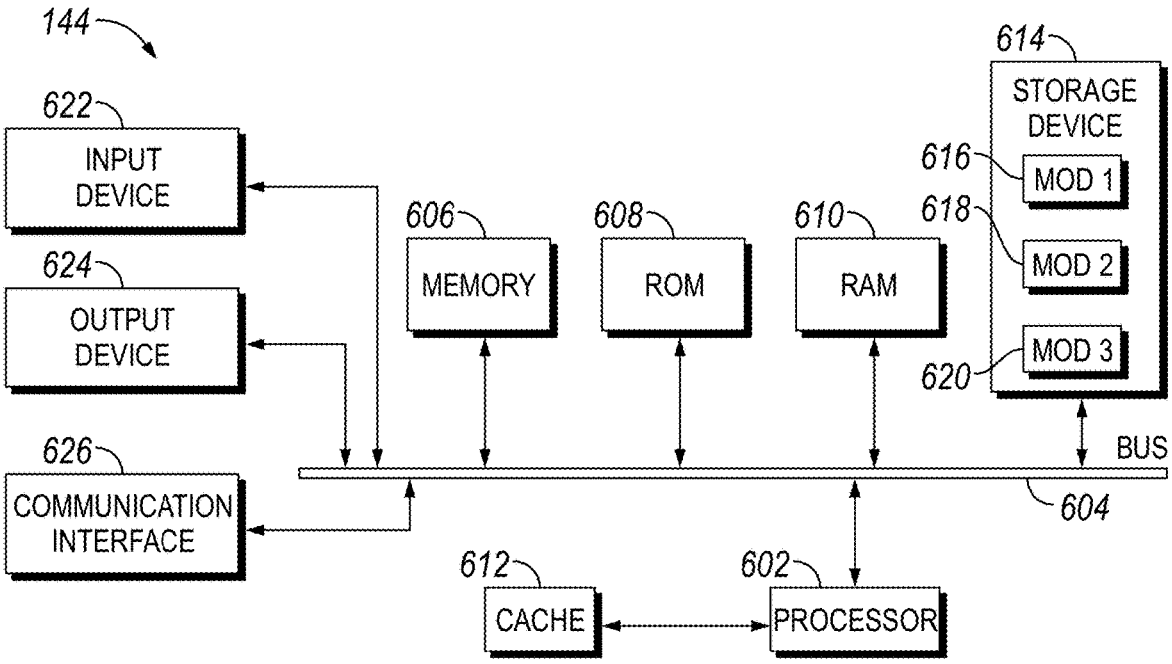
FIG. 6 illustrates an example information handling system.

FIG. 6 illustrates an example information handling system 144 which may be employed to perform various steps, methods, and techniques disclosed herein. As illustrated, information handling system 144 includes a processing unit (CPU or processor) 602 and a system bus 604 that couples various system components including system memory 606 such as read only memory (ROM) 608 and random-access memory (RAM) 610 to processor 602. Processors disclosed herein may all be forms of this processor 602. Information handling system 144 may include a cache 612 of high-speed memory connected directly with, in close proximity to, or integrated as part of processor 602. Information handling system 144 copies data from memory 606 and/or storage device 614 to cache 612 for quick access by processor 602. In this way, cache 612 provides a performance boost that avoids processor 602 delays while waiting for data. These and other modules may control or be configured to control processor 602 to perform various operations or actions. Other system memory 606 may be available for use as well. Memory 606 may include multiple different types of memory with different performance characteristics. It may be appreciated that the disclosure may operate on information handling system 144 with more than one processor 602 or on a group or cluster of computing devices networked together to provide greater processing capability. Processor 602 may include any general-purpose processor and a hardware module or software module, such as first module 616, second module 618, and third module 620 stored in storage device 614, configured to control processor 602 as well as a special-purpose processor where software instructions are incorporated into processor 602. Processor 602 may be a self-contained computing system, containing multiple cores or processors, a bus, memory controller, cache, etc. A multi-core processor may be symmetric or asymmetric. Processor 602 may include multiple processors, such as a system having multiple, physically separate processors in different sockets, or a system having multiple processor cores on a single physical chip. Similarly, processor 602 may include multiple distributed processors located in multiple separate computing devices but working together such as via a communications network. Multiple processors or processor cores may share resources such as memory 606 or cache 612 or may operate using independent resources. Processor 602 may include one or more state machines, an application specific integrated circuit (ASIC), or a programmable gate array (PGA) including a field PGA (FPGA).

Each individual component discussed above may be coupled to system bus 604, which may connect each and every individual component to each other. System bus 604 may be any of several types of bus structures including a memory bus or memory controller, a peripheral bus, and a local bus using any of a variety of bus architectures. A basic input/output (BIOS) stored in ROM 608 or the like, may provide the basic routine that helps to transfer information between elements within information handling system 144, such as during start-up. Information handling system 144 further includes storage devices 614 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 614 may include software modules 616, 618, and 620 for controlling processor 602. Information handling system 144 may include other hardware or software modules. Storage device 614 is connected to the system bus 604 by a drive interface. The drives and the associated computer-readable storage devices provide nonvolatile storage of computer-readable instructions, data structures, program modules and other data for information handling system 144. In one aspect, a hardware module that performs a particular function includes the software component stored in a tangible computer-readable storage device in connection with the necessary hardware components, such as processor 602, system bus 604, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 144 is a small, handheld computing device, a desktop computer, or a computer server. When processor 602 executes instructions to perform "operations", processor 602 may perform the operations directly and/or facilitate, direct, or cooperate with another device or component to perform the operations.

As illustrated, information handling system 144 employs storage device 614, which may be a hard disk or other types of computer-readable storage devices which may store data that are accessible by a computer, such as magnetic cassettes, flash memory cards, digital versatile disks (DVDs), cartridges, random access memories (RAMs) 610, read only memory (ROM) 608, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 144, an input device 622 represents any number of input mechanisms, such as a microphone for speech, a touch-sensitive screen for gesture or graphical input, keyboard, mouse, motion input, speech and so forth. Additionally, input device 622 may take in data from array of receivers 104 (e.g., referring to FIG. 3), discussed above. An output device 624 may also be one or more of a number of output mechanisms known to those of skill in the art. In some instances, multimodal systems enable a user to provide multiple types of input to communicate with information handling system 144. Communications interface 626 generally governs and manages the user input and system output. There is no restriction on operating on any particular hardware arrangement and therefore the basic hardware depicted may easily be substituted for improved hardware or firmware arrangements as they are developed.

As illustrated, each individual component described above is depicted and disclosed as individual functional blocks. The functions these blocks represent may be provided through the use of either shared or dedicated hardware, including, but not limited to, hardware capable of executing software and hardware, such as a processor 602, that is purpose-built to operate as an equivalent to software executing on a general-purpose processor. For example, the functions of one or more processors presented in FIG. 6 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 608 for storing software performing the operations described below, and random-access memory (RAM) 610 for storing returns. Very large-scale integration (VLSI) hardware embodiments, as well as custom VLSI circuitry in combination with a general-purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 144 may practice all or part of the recited methods, may be a part of the recited systems, and/or may operate according to instructions in the recited tangible computer-readable storage devices. Such logical operations may be implemented as modules configured to control processor 602 to perform particular functions according to the programming of software modules 616, 618, and 620.

In examples, one or more parts of the example information handling system 144, up to and including the entire information handling system 144, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately however, virtualized hardware of every type is implemented or executed by some underlying physical hardware. Thus, a virtualization compute layer may operate on top of a physical compute layer. The virtualization compute layer may include one or more virtual machines, an overlay network, a hypervisor, virtual switching, and any other virtualization application.

Figure 7:
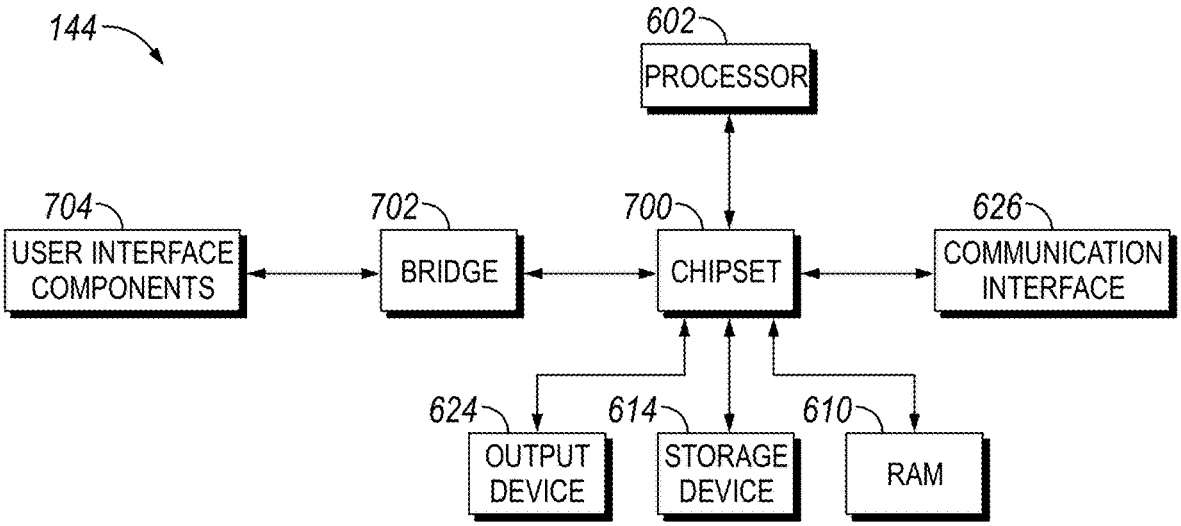
FIG. 7 illustrates another example information handling system.

FIG. 7 illustrates another example information handling system 144 having a chipset architecture that may be used in executing the described method and generating and displaying a graphical user interface (GUI). Information handling system 144 is an example of computer hardware, software, and firmware that may be used to implement the disclosed technology. Information handling system 144 may include a processor 602, representative of any number of physically and/or logically distinct resources capable of executing software, firmware, and hardware configured to perform identified computations. Processor 602 may communicate with a chipset 700 that may control input to and output from processor 602. In this example, chipset 700 outputs information to output device 624, such as a display, and may read and write information to storage device 614, which may include, for example, magnetic media, and solid-state media. Chipset 700 may also read data from and write data to RAM 610. Bridge 702 for interfacing with a variety of user interface components 704 may be provided for interfacing with chipset 700. Such user interface components 704 may include a keyboard, a microphone, touch detection and processing circuitry, a pointing device, such as a mouse, and so on. In general, inputs to information handling system 144 may come from any of a variety of sources, machine generated and/or human generated.

Chipset 700 may also interface with one or more communication interfaces 626 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 602 analyzing data stored in storage device 614 or RAM 610. Further, information handling system 144 may receive inputs from a user via user interface components 704 and execute appropriate functions, such as browsing functions by interpreting these inputs using processor 602.

In examples, information handling system 144 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hard-wired links, wireless links, or by a combination thereof) through a communications network. In a distributed computing environment, program modules may be located in both local and remote memory storage devices.

Improvements over current technology may be to determine borehole mud attenuation and speed measurement with Pitch Catch Pulse Echo measurements. This may be performed by shifting the radial location of one or more receivers. The non-shifted and shifted receiver waveforms are then individually processed. The products of each processed waveform may then be compared in a minimization process to yield borehole mud attenuation and velocity. The minimization establishes more accurate attenuation and velocity measurements for the mud and because of the effect of the radial shift in comparison to only in-line measurements. Systems and methods described herein may comprise occasions of using one or more of waveforms at one or more transmitters position with shifted radial positions since it also creates the difference in ray paths. Improvements may be to have one or more receivers or/and one or more transmitters with different radial distance. Systems and methods herein comprise receivers or transmitters with different radial shift may be applicable for different inversion methods as well. For example, the inversion method nay be gradient descent, coordinate descent, or close-form-solution method. According to reciprocity, the transmitters and receivers may be reversed. For an array of transmitters with at least one of the transmitters at a shifted positions and two or more transmitters at an in-line position. Cement evaluation may be performed in addition to calculation of mud properties with this setup.

The preceding description provides various examples of the systems and methods of use disclosed herein which may contain different method steps and alternative combinations of components.

Statement 1. A method comprising: disposing an acoustic logging tool into a borehole, wherein the acoustic logging tool is configured to: transmit one or more acoustic waves into the borehole with one or more transmitters; and receive one or more waveforms from the borehole or surrounding casing with an array of receivers, wherein one or more receivers from the array of receivers are in a shifted position and the other receivers are at an in-line position; calculating mud properties and performing cement evaluation by comparing waveforms from receivers at the shifted position to waveforms from receivers at the in-line positions.

Statement 2. The method of statement 1, further comprising predicting one or more waveforms at a shifted position with two waveforms recorded at an in-line position to form one or more predicted waveforms at a shifted position.

Statement 3. The method of statement 2, further comprising comparing the one or more predicted waveforms at a shifted position with at least one or more waveforms recorded at a shifted position to yield a borehole mud attenuation and/or velocity.

Statement 4. The method of statement 3, further comprising finding flexural attenuations in a casing using receivers from the array of receivers in the in-line positions.

Statement 5. The method of statement 4, further comprising finding flexural wave velocities traveling in the casing using the two or more receivers from the array of receivers in the in-line positions.

Statement 6. The method of statement 5, further comprising predicting one or more waveforms at a shifted position based at least on the flexural attenuation in the casing, flexural velocity in the casing, and an initial guess of mud attenuation and velocity based on a prior knowledge in mud properties.

Statement 7. The method of statement 6, wherein predicting one or more waveforms at a shifted radial position utilizes the flexural wave velocities and the flexural attenuation and an initial guess of mud attenuation and velocity based at least on a prior knowledge in mud properties.

Statement 8. The method of statement 7, wherein predicting one or more predicted waveforms at a shifted position comprises determining v waveform propagation with:

$$v(t) = A * e^{-i(\omega t+\varphi)}$$

where A is amplitude, w is angular velocity, and φ is initial phase, and t is time.

Statement 9. The method of statement 8, wherein predicting one or more predicted waveforms at a shifted position comprises solving for α attenuation with:

$$A(x) = A_0 * e^{-(\alpha x)}$$

where $A_0$ is an initial amplitude, x is a distance that the one or more waveforms travel.

Statement 10. The method of statement 9, wherein predicting one or more predicted waveforms at a shifted position comprises solving for mud velocity with α attenuation and waveform propagation v.

Statement 11. A system comprising: an acoustic logging tool disposed a borehole, wherein the acoustic logging tool is configured to: transmit one or more acoustic waves into the borehole with one or more transmitters; and receive one or more waveforms from the borehole or surrounding casing with an array of receivers, wherein one or more receivers from the array of receivers are in a shifted position and the other receivers are at an in-line position;

an information handing system configured to: calculate mud properties and perform cement evaluation by comparing waveforms from receivers at the shifted position to waveforms from receivers at the in-line positions.

Statement 12. The system of statement 11, wherein the information handling system is further configured to predict one or more waveforms at a shifted position with two waveforms recorded at an in-line position to form one or more predicted waveforms at a shifted position.

Statement 13. The system of statement 12, wherein the information handling system is further configured to compare the one or more predicted waveforms at a shifted position with at least one or more waveforms recorded at a shifted position to yield a borehole mud attenuation and/or velocity.

Statement 14. The system of statement 13, wherein the information handling system is further configured to find flexural attenuations in a casing using the two or more receivers from the array of receivers in the in-line positions.

Statement 15. The system of statement 14, wherein the information handling system is further configured to find flexural wave velocities traveling in the casing using the two or more receivers from the array of receivers in the in-line positions.

Statement 16. The system of statement 15, wherein the information handling system is further configured to predict one or more waveforms at a shifted position based at least on the flexural attenuation in the casing, flexural velocity in the casing, and an initial guess of mud attenuation and velocity based on a prior knowledge in mud properties.

Statement 17. The system of statement 16, wherein the information handling system is further configured to predict one or more waveforms at a shifted position based at least on the flexural attenuation in the casing, flexural velocity in the casing, and an initial guess of mud attenuation, and velocity based on a prior knowledge in mud properties.

Statement 18. The method of statement 7, wherein predicting one or more predicted waveforms at a shifted position comprises determining v waveform propagation with:

$$v(t) = A * e^{-i(\omega t+\phi)}$$

where A is amplitude, w is angular velocity, and φ is initial phase, and t is time.

Statement 19. The method of statement 8, wherein predicting one or more predicted waveforms at a shifted position comprises solving for α attenuation with:

$$A(x) = A_0 * e^{-(\alpha x)}$$

where $A_0$ is an initial amplitude, x is a distance that the one or more waveforms travel.

Statement 20. The system of statement 19, wherein predicting one or more predicted waveforms at a shifted position comprises solving for mud velocity with α attenuation and waveform propagation v.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

disposing an acoustic logging tool into a borehole, wherein the acoustic logging tool is configured to:

transmit one or more acoustic waves into the borehole with one or more transmitters; and receive one or more waveforms from the borehole or surrounding casing with an array of receivers, wherein one or more receivers from the array of receivers are in a shifted position and two or more receivers are at an in-line position and not at the shifted position;

calculating mud properties and performing cement evaluation by comparing waveforms from receivers at the shifted position to waveforms from receivers at the in-line positions.

2. The method of claim 1, further comprising predicting one or more waveforms at a shifted position with two waveforms recorded at an in-line position to form one or more predicted waveforms at a shifted position.

3. The method of claim 2, further comprising comparing the one or more predicted waveforms at a shifted position with at least one or more waveforms recorded at a shifted position to yield a borehole mud attenuation and/or velocity.

4. The method of claim 3, further comprising finding flexural attenuations in a casing using receivers from the array of receivers in the in-line positions.

5. The method of claim 4, further comprising finding flexural wave velocities traveling in the casing using the two or more receivers from the array of receivers in the in-line positions.

6. The method of claim 5, further comprising predicting one or more waveforms at a shifted position based at least on the flexural attenuation in the casing, and flexural velocity in the casing.

7. The method of claim 6, wherein predicting one or more waveforms at a shifted radial position further comprises an initial guess of mud attenuation and velocity based at least on a prior knowledge in mud properties.

8. The method of claim 7, wherein predicting one or more predicted waveforms at a shifted position comprises determining v waveform propagation with:

$$v(t) = A * e^{-i(\omega t+\phi)}$$

where A is amplitude, w is angular velocity, and φ is initial phase, and t is time.

9. The method of claim 8, wherein predicting one or more predicted waveforms at a shifted position comprises solving for α attenuation with:

$$A(x) = A_0 * e^{-(\alpha x)}$$

where $A_0$ is an initial amplitude, x is a distance that the one or more waveforms travel.

10. The method of claim 9, wherein predicting one or more predicted waveforms at a shifted position comprises solving for mud velocity with α attenuation and waveform propagation v.

11. A system comprising:

an acoustic logging tool disposed a borehole, wherein the acoustic logging tool is configured to:

transmit one or more acoustic waves into the borehole with one or more transmitters; and receive one or more waveforms from the borehole or surrounding casing with an array of receivers, wherein one or more receivers from the array of receivers are in a shifted position and two or more the other receivers are at an in-line position and not at the shifted position;

an information handing system configured to:

calculate mud properties and perform cement evaluation by comparing waveforms from receivers at the shifted position to waveforms from receivers at the in-line positions.

12. The system of claim 11, wherein the information handling system is further configured to predict one or more waveforms at a shifted position with two waveforms recorded at an in-line position to form one or more predicted waveforms at a shifted position.

13. The system of claim 12, wherein the information handling system is further configured to compare the one or more predicted waveforms at a shifted position with at least one or more waveforms recorded at a shifted position to yield a borehole mud attenuation and/or velocity.

14. The system of claim 13, wherein the information handling system is further configured to find flexural attenuations in a casing using the two or more receivers from the array of receivers in the in-line positions.

15. The system of claim 14, wherein the information handling system is further configured to find flexural wave velocities traveling in the casing using the two or more receivers from the array of receivers in the in-line positions.

16. The system of claim 15, wherein the information handling system is further configured to predict one or more waveforms at a shifted position based at least on the flexural attenuation in the casing, flexural velocity in the casing.

17. The system of claim 16, wherein the information handling system is further configured to predict one or more waveforms at a shifted position based at least on an initial guess of mud attenuation, and velocity based on a prior knowledge in mud properties.

18. The system of claim 17, wherein predicting one or more predicted waveforms at a shifted position comprises determining v waveform propagation with:

$$v(t) = A * e^{-i(\omega t + \varphi)}$$

where A is amplitude, w is angular velocity, and φ is initial phase, and t is time.

19. The system of claim 18, wherein predicting one or more predicted waveforms at a shifted position comprises solving for α attenuation with:

$$A(x) = A_0 * e^{-(\alpha x)}$$

where $A_0$ is an initial amplitude, x is a distance that the one or more waveforms travel.

20. The system of claim 19, wherein predicting one or more predicted waveforms at a shifted position comprises solving for mud velocity with α attenuation and waveform propagation v.

* * * * *